US011788310B2

(12) United States Patent
Tai

(10) Patent No.: US 11,788,310 B2
(45) Date of Patent: Oct. 17, 2023

(54) INFLATABLE POOL AND METHOD FOR MANUFACTURING THE SAME

(71) Applicant: JIANGSU JILONG SPORT AND LEISURE PRODUCTS CO., LTD., Jiangsu (CN)

(72) Inventor: Xuming Tai, Shanghai (CN)

(73) Assignee: JIANGSU JILONG SPORT AND LEISURE PRODUCTS CO., LTD., Suqian (CN)

( * ) Notice: Subject to any disclaimer, the term of this patent is extended or adjusted under 35 U.S.C. 154(b) by 163 days.

(21) Appl. No.: 17/424,374

(22) PCT Filed: Aug. 31, 2020

(86) PCT No.: PCT/CN2020/112428
§ 371 (c)(1),
(2) Date: Jul. 20, 2021

(87) PCT Pub. No.: WO2021/237969
PCT Pub. Date: Dec. 2, 2021

(65) Prior Publication Data

US 2022/0307278 A1 Sep. 29, 2022

(30) Foreign Application Priority Data

May 26, 2020 (CN) ..... 202010457451.3

(51) Int. Cl.
*E04H 4/00* (2006.01)

(52) U.S. Cl.
CPC ..... *E04H 4/0025* (2013.01)

(58) Field of Classification Search
CPC ..... E04H 4/0025
USPC ..... 4/513, 506, 585
See application file for complete search history.

(56) References Cited

U.S. PATENT DOCUMENTS

2019/0085576 A1 3/2019 Lin et al.

FOREIGN PATENT DOCUMENTS

| | | | | |
|---|---|---|---|---|
| CN | 203716538 U | | 7/2014 | |
| CN | 205189446 U | | 4/2016 | |
| CN | 106567563 A | | 4/2017 | |
| CN | 107548285 A | * | 1/2018 | ..... A45C 11/20 |
| CN | 209933437 U | | 1/2020 | |

(Continued)

OTHER PUBLICATIONS

International Search Report for PCT/CN2020/112428 (dated Feb. 20, 2021).

*Primary Examiner* — Tuan N Nguyen
(74) *Attorney, Agent, or Firm* — Merchant & Gould P.C.

(57) ABSTRACT

An inflatable pool and a method for manufacturing the same are provided. An inner wall of the inflatable pool is provided with at least two inner wall joints each extending along a direction perpendicular to a pool base. After the inflatable pool is inflated, a corner is formed on the inner wall at a position of each of the inner wall joints; an outer wall is provided with at least one outer wall joint extending along the direction perpendicular to the pool base. According to the inflatable pool of the present application, the at least two inner wall joints and the at least one outer wall joint are provided on the inner wall and the outer wall respectively, which is easy for forming the corner on the inner wall after inflation, to form the polygon-shaped inflated pool, thus air leakage hardly occurs.

15 Claims, 2 Drawing Sheets

(56) References Cited

FOREIGN PATENT DOCUMENTS

| | | | | | |
|---|---|---|---|---|---|
| CN | 111576946 | A | | 8/2020 | |
| WO | WO-2018189741 | A1 | * | 10/2018 | ..... E04H 4/0025 |

* cited by examiner

INFLATABLE POOL AND METHOD FOR MANUFACTURING THE SAME

The present application is the national phase of International Application No. PCT/CN 2020/112428, titled "INFLATABLE POOL AND METHOD FOR MANUFACTURING THE SAME", filed on Aug. 31, 2020, which claims the priority to Chinese Patent Application No. 202010457451.3, titled "INFLATABLE POOL AND METHOD FOR MANUFACTURING THE SAME", filed with the China National Intellectual Property Administration on May 26, 2020, the entire disclosures thereof are incorporated herein by reference.

FIELD

The present application relates to the technical field of inflatable pools, and in particular to an inflatable pool and a method for manufacturing the inflatable pool.

BACKGROUND

Inflatable pools are increasingly used because of advantages that the operation and disassembly are convenient, the size and shape can be flexibly customized as required. In order to be sturdier, drop stitch materials are usually used in conventional inflatable SPA pools. The drop stitch material is smooth when inflated directly and thus corners cannot be formed. Therefore, most inflatable water pools made of drop stitch materials are circular-shaped. In order to ensure roundness of the inflatable water pool to facilitate manufacturing, the wall thickness is generally small, which is not more than 5 cm, resulting in poor thermal insulation performance. If the inflatable water pool is polygon-shaped, major air leakage points are apt to be formed at positions where sides intersect with each other, which affects the overall performance.

SUMMARY

An object of the present application is to provide an inflatable pool and a manufacturing method thereof, to solve the problems of poor thermal insulation performance and air leakage of conventional inflatable water pools.

To achieve this object, the following technical solutions are provided according to the present application.

An inflatable pool includes a pool base, an inner wall and an outer wall. The pool base is surrounded by the inner wall to form a water accommodation basin, an inflatable chamber is defined between the inner wall and the outer wall, and a drop stitch structure for connecting the inner wall and the outer wall is provided in the inflatable chamber. The inner wall is provided with at least two inner wall joints each extending along a direction perpendicular to the pool base, and in a case that the inflatable pool is inflated, a corner is formed on the inner wall at a position of each of the inner wall joints. The outer wall is provided with at least one outer wall joint extending along the direction perpendicular to the pool base.

In an embodiment, at the position of each of the inner wall joints, the inner wall is broken along the direction perpendicular to the pool base, and the broken inner wall is connected through the inner wall joints.

In an embodiment, the drop stitch structure located between the inner wall and the outer wall is broken at a position corresponding to each of the inner wall joints.

In an embodiment, the inner wall is folded into the drop stitch structure at the position of each of the inner wall joints, and the folded inner wall is connected through the inner wall joint.

In an embodiment, at the position of the outer wall joint, the outer wall is broken along a direction perpendicular to the pool base, and the broken outer wall is connected through the outer wall joint.

In an embodiment, a position of the outer wall joint corresponds to the position of the inner wall joint located at the corner.

In an embodiment, the inner wall is connected by the inner wall joints adopting an edge sealing material, and the outer wall is connected by the outer wall joint adopting the edge sealing material, to form a sealing layer.

In an embodiment, the inflatable pool further includes at least one first reinforcing layer configured to coat the sealing layer and edges of the sealing layer.

In an embodiment, a top of the inner wall and a top of the outer wall are connected by an edge sealing layer, and a bottom of the inner wall and a bottom of outer wall are connected by another edge sealing layer.

In an embodiment, the edge sealing layer located at the top has at least two edge sealing joints; and two ends, located at two sides of each of the edge sealing joints, of the edge sealing layer are connected in an overlapping manner at a position of the corresponding edge sealing joint.

In an embodiment, positions of the edge sealing joints correspond to positions of the inner wall joints.

In an embodiment, the inflatable pool further includes at least one second reinforcing layer configured to coat edges of the edge sealing joints and an edge of the edge sealing layer, and the second reinforcing layer is provided on an outer side and/or an inner side of the inflatable chamber.

A method for manufacturing an inflatable pool is provided for manufacturing the inflatable pool according to the present application. The method includes the following steps:

- preparing a pool wall of a drop stitch material, and making the pool base be surrounded by the pool wall to form the water accommodation basin; where the pool wall includes the inner wall and the outer wall, and the drop stitch structure therebetween;
- providing the at least two of the inner wall joints, each extending along the direction perpendicular to the pool base, on the inner wall;
- providing the at least one outer wall joint, extending along the direction perpendicular to the pool base, on the outer wall; and
- forming, by the inner wall, the corner at each of the inner wall joints after the inflatable pool is inflated.

In an embodiment, before being provided with the inner wall joints, the inner wall is first broken along the direction perpendicular to the pool base, or folded into the drop stitch structure, and then the inner wall which is broken or folded, is connected through the inner wall joints. Before being provided with the outer wall joint, the outer wall is first broken along the direction perpendicular to the pool base, and then the outer wall which is broken, is connected through the outer wall joint.

In an embodiment, if the inner wall is broken, the drop stitch structure located between the inner wall and the outer wall is required to be broken at a position corresponding to each of the inner wall joints before the inner wall joints are provided.

The beneficial effects of the present application are as follows.

According to the inflatable pool and the method for manufacturing the inflatable pool of the present application, the at least two inner wall joints and the at least one outer wall joint are provided on the inner wall and the outer wall respectively, which is easy for forming the corner on the inner wall after inflation, to form the polygon-shaped inflated pool, thus air leakage can hardly occur. Besides, a thickness of each of the inner wall and the outer wall may be increased to more than 10 cm as required, to improve the thermal insulation performance.

Figure 1:
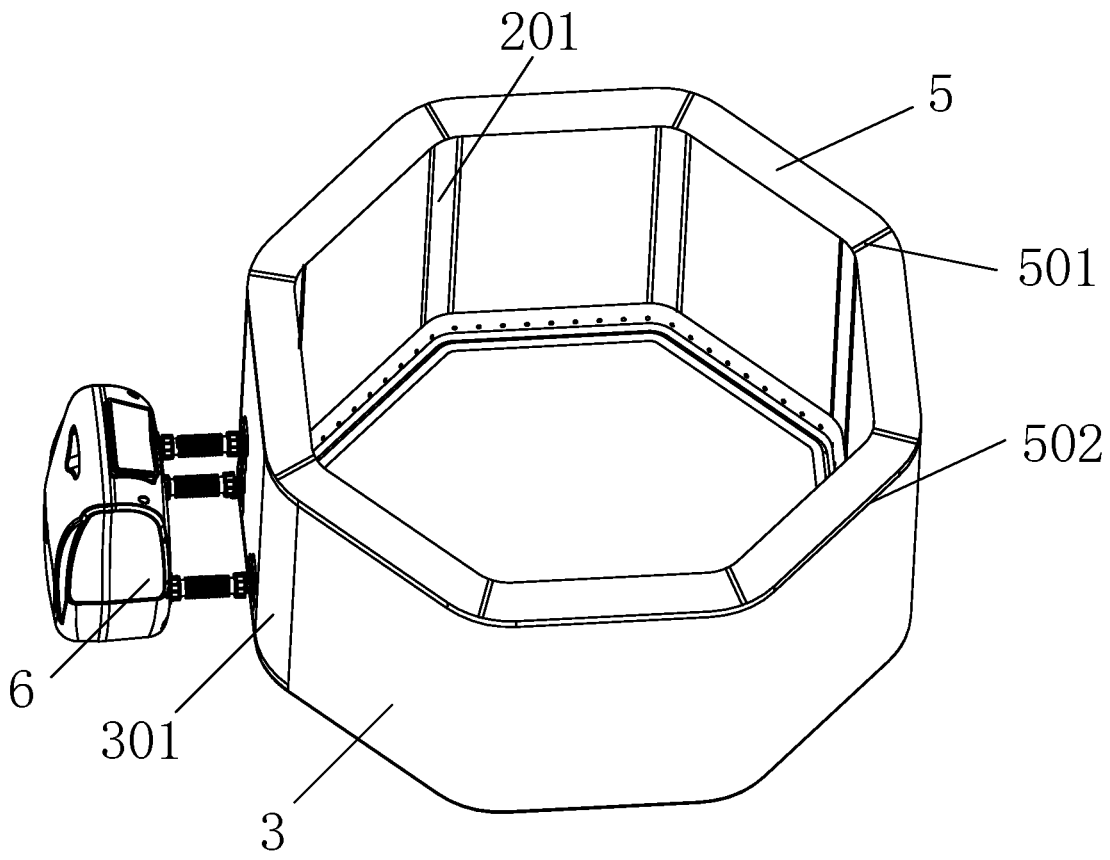
FIG. 1 is a schematic view showing the structure of an inflatable pool according to the present application.

| | | | |
|---|---|---|---|
| 1 | pool base, | 2 | inner wall, |
| 201 | inner wall joint, | 3 | outer wall, |
| 301 | outer wall joint, | 4 | wave generating band, |
| 5 | edge sealing layer, | 501 | edge sealing joint, |
| 502 | second reinforcing layer, | 6 | air pump, |
| 7 | drop stitch structure. | | |

DETAILED DESCRIPTION OF THE EMBODIMENTS

The present application will be described hereinafter in conjunction with the drawings and the embodiments. It can be understood that the specific embodiments described herein are only used to explain the present application rather than to limit the present application. It should further be noted that, for ease of description, the drawings only show a part of the structures related to the present application rather than all of the structures.

In the description of the present application, unless otherwise clearly specified and limited, the terms "linked", "connected", and "fixed" shall be interpreted broadly, for example, may be interpreted as fixedly connected, detachably connected, or integrated; the terms may be interpreted as mechanically connected or electrically connected; the terms may also be interpreted as directly connected or indirectly connected through an intermediate medium, the terms may further be interpreted as internal communication between two components or interaction relationship between two components. For those of ordinary skill in the art, the specific meanings of the terms in the present application may be understood in specific situations.

In the present application, unless otherwise clearly defined and limited, a first feature being "above" or "below" a second feature may include situations that the first and second features are in contact with each other directly, or the first and second features being in contact with each other indirectly and via another feature between them. Moreover, the first feature being "above", "on top of" and "over" the second feature may include situations that the first feature are right above and obliquely above the second feature, or it simply means that the first feature is higher in horizontal level than the second feature. The first feature being "below", "under" and "lower than" the second feature may include situations that the first feature being right below and obliquely below the second feature, or it simply means that the first feature is lower in horizontal level than the second feature.

In the description of the embodiment, the terms "top", "bottom", "right", and other orientations or positional relationships are the orientations or positional relationships shown based on the drawings, and are only for ease of description and simplification of operation, rather than for indicating or implying that a specific device or element must have a specific orientation, or be constructed and operated in a specific orientation. Therefore, the terms may not be understood as limitations to the present application. In addition, the terms "first" and "second" are only used for distinguishing of description and have no special meanings.

Figure 2:
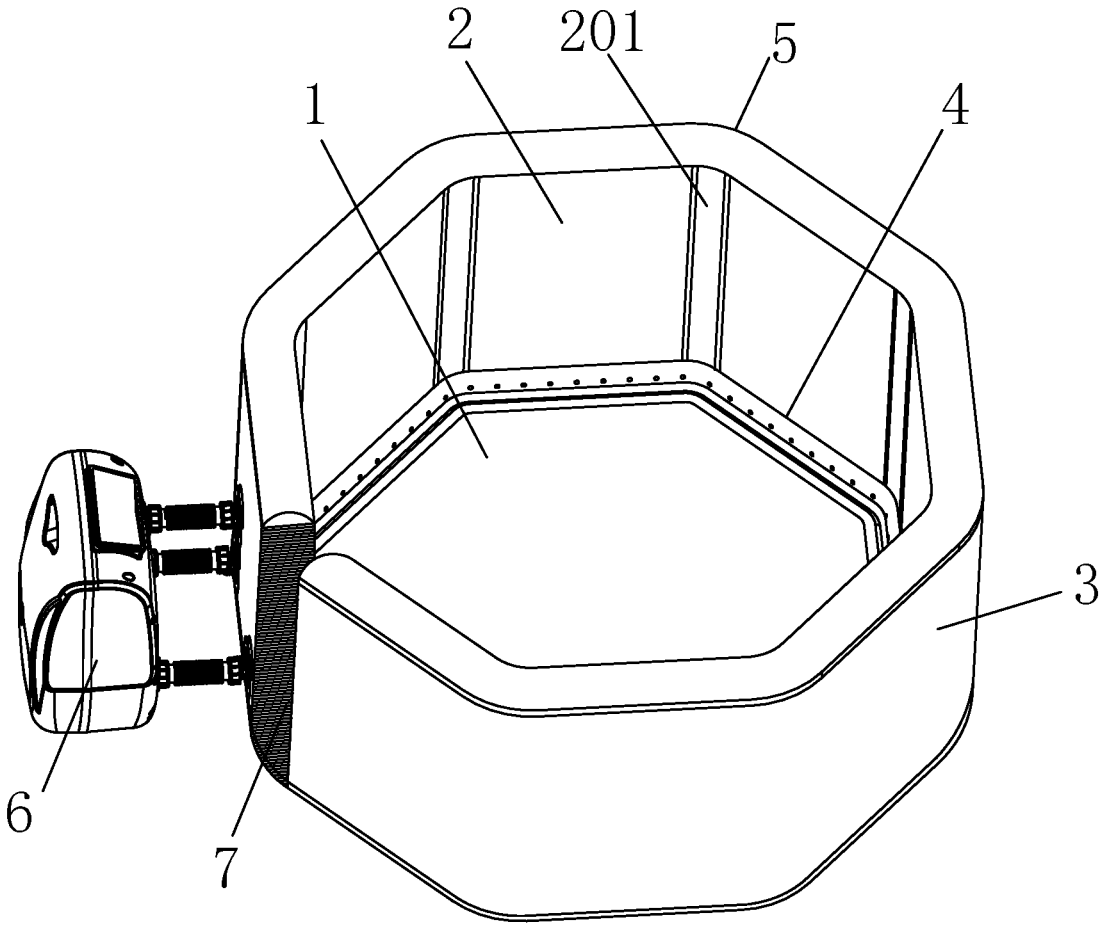
FIG. 2 is a schematic view showing a drop stitch structure on a cross section of a wall pool of the inflatable pool according to the present application.

An inflatable pool is provided according to the present application, as shown in FIGS. 1 and 2, including a pool base 1, an inner wall 2 and an outer wall 3. The pool base 1 is surrounded by the inner wall 2 to form a water accommodation basin, an inflatable chamber is defined between the inner wall 2 and the outer wall 3, and a drop stitch structure 7 for connecting the inner wall 2 and the outer wall 3 is provided in the inflatable chamber. The inner wall 2 is provided with at least two inner wall joints 201 each extending along a direction perpendicular to the pool base, and in a case that the inflatable pool is inflated, a corner is formed on the inner wall 2 at a position of each of the inner wall joints 201. The outer wall 3 is provided with at least one outer wall joint 301 extending along the direction perpendicular to the pool base 1.

It can be understood that, the inner wall 2 and the outer wall 3 in the present application are provided with the at least two inner wall joints 201 and the at least one outer wall joint 301, respectively, which is easy for forming the corner on the inner wall 2 after inflation, to form a polygon-shaped inflatable pool, thus air leakage can hardly occur. Besides, a thickness of each of the inner wall 2 and the outer wall 3 may be increased to more than 10 cm as required, to improve the thermal insulation performance.

It should be explained that, a pool wall of the inflatable pool provided according to the present application is made of the drop stitch material, that is, the drop stitch structure 7 is provided between the inner wall 2 and the outer wall 3. Due to the inherent strength of the drop stitch structure 7, the pool wall is not easy to deform, so the pool wall may only be flat, or the pool wall is made very thin to form a circular-shaped inflatable pool, but the thermal insulation performance of the thin wall is quite poor, and it is not easy to manufacture a thermally insulated SPA inflatable pool by using the thin wall. Therefore, the drop stitch material is improved in the present application. By providing the inner wall joints 201 and the outer wall joint 301, the inner wall 2 has at least two inner wall joints 201, and the corner is formed at each of the inner wall joints 201 after inflation, so the inflatable pool may be made into a shape of an arbitrary polygon. Moreover, since corners are formed at both the inner wall 2 and the outer wall 3, a thickness of the pool wall between two corners may be increased, to improve the thermal insulation performance.

In an embodiment, at the position of each of the inner wall joints 201, the inner wall 2 is broken along the direction perpendicular to the pool base 1, and the broken inner wall 2 is connected through the inner wall joint 201. If the inner wall 2 is directly bent, a folded corner will be formed, resulting in air leakage problems. In order to solve the problem of the inner wall 2 bending, the inner wall 2 is broken in the vertical direction and then re-connected via the inner wall joints 201, to avoid the problem of internal bending and air leakage which easily occurs, which is conducive to forming of a water accommodation basin with corners to accommodate more water.

In an embodiment, as shown in FIG. 2, the drop stitch structure 7 between the inner wall 2 and the outer wall 3 is broken at a position corresponding to each of the inner wall joints 201. In order to avoid the interference of the drop stitch structure 7 on the inner wall 2 at positions of the corners, the drop stitch structure 7 is broken at corresponding positions, to facilitate connecting two joint ends of breaking of the inner wall 2 with the corresponding inner wall joint 201.

In other embodiments, the inner wall 2 is folded into the drop stitch structure 7 at the position of each of the inner wall joints 201, and the folded inner wall 2 is connected through the inner wall joints 201. As an implementable technical solution, it can be understood that when the inner wall 2 is bent as required, wrinkles are formed at a bending part of the inner wall 2 and a larger tensile force is generated at the outer wall 3. In order to be more conducive to deformation, in this embodiment, the bending part of the inner wall 2 is folded toward the outer wall 3, that is, it is folded to the inside of the drop stitch structure 7, and two side edges are formed. A degree of folding is related to the corner required to be formed. The two side edges are connected through the corresponding inner wall joint 201, to form the inflatable pool with a specific corner type. Of course, in the above folding process, the inner wall 2 can be folded after being broken, or can be directly folded without being broken.

In an embodiment, at the position of the outer wall joint 301, the outer wall 3 is broken along the direction perpendicular to the pool base 1, and the broken outer wall 3 is connected through the outer wall joint 301. Similar to the manner in which the inner wall joint 201 is connected to the inner wall 2, the outer wall 3 is longitudinally broken at the position where a corner is required to be formed, and then the two broken parts are connected through the outer wall joint 301, to facilitate the formation of the corner, so as to obtain the inflatable pool having a shape of an arbitrary polygon.

In an embodiment, a position of the outer wall joint 301 corresponds to the position of the inner wall joint 201 at the corner. It can be understood that, in a case that only one outer wall joint 301 is provided, the outer wall joint 301 is connected at a connecting position of the pool wall when the pool wall surrounds the pool base 1, the outer wall joint 301 and the inner wall joint 201 are connected to the outer wall 3 and the inner wall 2 respectively at the connecting position, thus, the position of the outer wall joint 301 and the position of the inner wall joint 201 are corresponding to each other. In a case that two or more inner wall joints 2 and two or more outer wall joints 301 are provided, the number of inner wall joints 2 is selected according to the shape of the inflatable pool, and the positions of the outer wall joints 3 are in one-to-one correspondence with the positions of the corresponding inner wall joints 201 of the two or more inner wall joints 201, so as to form a regular-shaped inflatable pool.

In an embodiment, the inner wall 2 is connected by the inner wall joints 201 adopting an edge sealing material, and the outer wall 3 is connected by the outer wall joint 301 adopting the edge sealing material, to form a sealing layer. For the inner wall 2 and the outer wall 3 which are longitudinally broken, or the inner wall 2 which is folded, the edge sealing material is used for connecting seams of the two broken parts, to serve as the inner wall joint 201 or the outer wall joint 301. The connection should be performed in a manner which facilitates formation of the corners. Therefore, the edge sealing material should be a soft material which may facilitate connection of the inner wall 2 and the outer wall 3. The connection manner may be welding or adhesive bonding. After the connection is done, the sealing layer is formed on the previously broken position.

The above inner wall joints 201 and the outer wall joint 301 above are provided for forming the corners on the inflatable pool at the corresponding positions to form a polygon-shaped inflatable pool, therefore, it is not limited that two or more inner wall joints 201 or the outer wall joints 301 are provided at one of the corners.

In an embodiment, the inflatable pool according to the present application further includes at least one first reinforcing layer configured to coat the sealing layer and edges of the sealing layer. The first reinforcing layer completely covers an outer side of the sealing layer, to seal and reinforce the edges of the sealing layer. Two or more first reinforcing layers may be provided as required, to cover the sealing layer in sequence. The first reinforcing layer is connected by welding or adhesive bonding.

In an embodiment, a top of the inner wall 2 and a top of the outer wall 3 are connected by an edge sealing layer 5, and a bottom of the inner wall 2 and a bottom of the outer wall 3 are connected by another edge sealing layer 5. It should be explained that, the bottom of the inner wall 2 and the bottom of the outer wall 3 are connected by the edge sealing layer 5, to form the pool base 1 directly or overlap with the pool base 1. When the top of the inner wall 2 and the top of the outer wall 3 are connected by the edge sealing layer 5, a top seal of the inflatable chamber is formed, and the edge sealing layer 5 is respectively connected to the inner wall 2 and the outer wall 3 by welding or adhesive bonding.

The edge sealing layer 5 located at the top has at least two edge sealing joints 501, and two ends, located at two sides of each of the edge sealing joints 501, of the edge sealing layer 5 are connected in an overlapping manner at a position of the corresponding edge sealing joint 501. The edge sealing joint 501 has the same effect as the inner wall joint 201 and the outer wall joint 301, which is provided to form a corner with a smooth transition. Therefore, it is preferable that positions of the edge sealing joints 501 correspond to positions of the inner wall joints 201. Also, the edge sealing joint 501 is connected in a manner that the edge sealing layer 5 is first overlapped and then connected, which increases the strength of the edge sealing joint 501 and further improves the connection strength of the top of the inner wall joint 201.

In an embodiment, the inflatable pool further includes at least one second reinforcing layer 502 configured to coat edges of the edge sealing joints 501 and an edge of the edge sealing layer 5, and the second reinforcing layer 502 is provided on an outer side and/or an inner side of the inflatable chamber. As shown in FIG. 2, the second reinforcing layer 502 functions to reinforce and seal the edge sealing layer 5 and the edge sealing joints 501. Therefore, the second reinforcing layer 502 is required to cover side edges of the edge sealing layer 5 along the inner wall 2 and the outer wall 3, edges of the edge sealing joint 501 along the inner wall 2 and the outer wall 3, and edges of the edge sealing joint 501 located above the edge sealing layer 5. Multiple second reinforcing layers 502 may be provided for covering in sequence and then connected by welding or adhesive bonding. Where, the second reinforcing layer 502 may be only provided on the outer side of the inflatable chamber, or may be only provided on the outer side of the inflatable chamber, or at least one second reinforcing layer 502 is provided on each of the inner side and the outer side of the inflatable chamber, to reinforce and fix the edge sealing layer 5 and the edge sealing joints 501, so as to prevent air leakage.

In a preferred embodiment of the present application, the inflatable pool further includes a wave generating band 4, which is arranged on the inner wall 2. The wave generating band 4 is provided with multiple air outlet holes and one air inlet hole, where the air inlet hole is connected with an external air pump 6 through an air tube; and the air outlet holes are connected to the water accommodation basin. The external air pump 6 can continuously introduce air into the wave generating band 4 through the air inlet hole, and the air enters the water accommodation basin through the air outlet holes to achieve a wave generating effect. The number and diameter of the air outlet holes can be designed into different specifications according to actual needs. Generally, the wave generating band 4 is arranged at a position on the inner wall 2 which is near the pool base 1, and an air outlet direction of each of the air outlet holes faces a center of the inflatable pool.

Specifically, as shown in FIGS. 1 and 2, the inflatable pool in the embodiment is a polygon-shaped pool, and the pool wall is made of a drop stitch material. Eight inner wall joints 201 are evenly distributed at intervals on the inner wall 2, eight outer wall joints 301 are evenly distributed at intervals on the outer wall 3, and positions of the inner wall joints 201 are in a one-to-one correspondence with positions of the outer wall joints 301. The inner wall 2 is broken at each of the inner wall joints 201, along the direction perpendicular to the pool base 1, and the broken inner wall 2 is re-connected through the inner wall joints 201. The broken inner wall 2 is re-connected by the inner wall joints 201 adopting the edge sealing material, to form a sealing layer. A surface of the sealing layer is coated with at least one first reinforcing layer, to improve the sealing performance and the strength at the inner wall joints 201. The outer wall 3 is broken at each of the outer wall joints 301, along the direction perpendicular to the pool base 1, and the broken outer wall 3 is re-connected through the outer wall joints 301. The broken outer wall 3 is re-connected by the outer wall joints 301 adopting the edge sealing material, to form a sealing layer. A surface of the sealing layer is coated with at least one first reinforcing layer, to improve the sealing performance and strength at the outer wall joints 301.

More specifically, a top of the inner wall 2 and a top of the outer wall 3 are connected through an edge sealing layer 5, and a bottom of the inner wall 2 and a bottom of the outer wall 3 are connected through another edge sealing layer 5 respectively, where the another edge sealing layer 5 located at the bottom overlaps with the pool base 1 and is connected with the pool base 1 in a sealed manner. The edge sealing layer 5 located at the top is used to seal the inflatable chamber, and the edge sealing layer 5 located at the top is provided with edge sealing joints 501. There are eight edge sealing joints 501, which corresponds to the positions of the inner wall joints 201 and the outer wall joints 301. Besides, at least one second reinforcing layer 502 is covered on the outside of the edge sealing layer 5, an outer side of the edge sealing layer 5 is covered with at least one second reinforcing layer 502, edges of the at least one second reinforcing layer 502 should cover edges of the edge sealing layer 5 and edges of the edge sealing joints 501, so as to perform the sealing and reinforcing function.

More specifically, after the inflatable pool is inflated, corners are formed at the inner wall joints 201 and the outer wall joints 301, to obtain a regular octagonal inflatable pool. A wave generating band 4, connected to an external air pump 6, is arranged at the bottom of the inner wall 2 of the inflatable pool, to obtain an inflatable pool with SPA function.

According to the above inflatable pool, by providing the inner wall joints and the outer wall joints made of the drop stitch material on the inner wall and the outer wall respectively, the inflatable pool which has corners after inflation is formed. Except for positions at the corners, the inflatable pool is a flat surface inflatable structure made of the drop stitch material. Therefore, a thickness of the drop stitch material of each side of the inflatable pool may be increased to more than 10 cm, to improve the thermal insulation performance of the inflatable pool made of the drop stitch material. In addition, since the inner wall joints 201 and the outer wall joints 301 are provided at the corners, there are no sharp creases at the corners, and the sealing performance of the inflatable chamber is improved.

A method for manufacturing an inflatable pool is further provided for manufacturing the inflatable pool according to the present application, the manufacturing method includes following steps:

preparing a pool wall of a drop stitch material, and making the pool base 1 be surrounded by the pool wall to form the water accommodation basin; where the pool wall includes the inner wall 2 and the outer wall 3, and the drop stitch structure 7 therebetween;

providing the at least two of the inner wall joints 201, each extending along the direction perpendicular to the pool base 1, on the inner wall 2;

providing the at least one outer wall joint 301, extending along the direction perpendicular to the pool base 1, on the outer wall 3; and forming, by the inner wall 2, the corner at each of the inner wall joints 201 after the inflatable pool is inflated.

In an embodiment of the present application, the drop stitch material is configured to be belt-shaped. There is a connecting position when the belt-shaped pool wall surrounds the pool base 1. The present application employs the inner wall joint 201 and the outer all joint 301 to connect ends of the belt-shaped pool wall. Besides, at least one inner wall joint 201 is added to the inner wall 2, to form corners at the inner wall joints after inflation, which is conducive to formation of an inflatable pool having a shape of an arbitrary polygon.

In an embodiment, before being provided with the inner wall joints 201, the inner wall 2 is first broken along the direction perpendicular to the pool base 1, or folded into the drop stitch structure 7, and then the inner wall 2 which is broken or folded, is re-connected through the inner wall joints 201. Before being provided with the outer wall joint 301, the outer wall 3 is first broken along the direction perpendicular to the pool base 1, and then the outer wall 3 which is broken, is re-connected through the outer wall joint 301. Since the pool wall in the present application is made of the drop stitch material, if the pool base 1 is surrounded by the drop stitch material directly to form a polygonal or circular shape, the drop stitch material is required to be thinned as much as possible to obtain a better-shaped inflatable pool. However, according to the present application, in order to solve the problem of poor thermal insulation performance of the inflatable pool made of the thin-walled drop stitch material, the drop stitch material is thickened (to more than 10 cm), to improve the thermal insulation performance of the inflatable pool. In view of this, in a case that the inner wall of the inflatable pool is deformed at corners, in order to avoid possible effects made by the internal drop stitch structure 7 on the quality of the pool wall at the corners of the inner wall 2, where the effects includes, but is not limited to, air leakage etc., a fracture is firstly formed in the inner wall 2, and then an edge sealing material is used to provide connection and sealing at the fracture, to form a sealing layer, that is, the manner of providing the inner wall joint 201. In an embodiment, wrinkles formed at the corners of the inner wall 2 may be folded into the drop stitch structure 7, to form two edges, and the two edges are sealed with the edge sealing material, thus forming the inner wall joint.

In an embodiment, if the inner wall 2 is broken, the drop stitch structure 7 located between the inner wall 2 and the outer wall 3 is required to be broken at a position corresponding to each of the inner wall joints 201 before the inner wall joints 201 are provided. The drop stitch structure 7 is broken mainly to ensure that the corner at each of the inner wall joints 201 can be smoother without sharp angles, and the outer wall 3 may be adaptively deformed with the shape of the inner wall 2, to form an inflatable pool with a controllable shape.

According to the method for manufacturing the inflatable pool of the present application, by providing at least two inner wall joints and at least one outer wall joint are provided on the inner wall and the outer wall respectively, it is easy to form corners on the inner wall after inflation, to form a polygon-shaped inflatable pool, and thus air leakage hardly occurs. Moreover, the thickness of the inner wall and the outer wall may be increased to more than 10 cm as required, thereby improving the thermal insulation performance.

Obviously, the above embodiments of the present application are merely examples for clearly illustrating the present application, and are not intended to limit the implementations of the present application. For those of ordinary skill in the art, various obvious changes, modifications and substitutions can be made without departing from the protection scope of the present application. It is unnecessary and impossible to list all the implementations herein. Any modification, equivalent replacement and improvement made within the spirit and principle of the present application are deemed to fall into the protection scope of claims of the present application.

The invention claimed is:

1. An inflatable pool, comprising:

a pool base, an inner wall, and an outer wall; wherein the pool base is surrounded by the inner wall to form a water accommodation basin, an inflatable chamber is defined between the inner wall and the outer wall, and a drop stitch structure for connecting the inner wall and the outer wall is provided in the inflatable chamber; and wherein the inner wall is provided with at least two inner wall joints each extending along a direction perpendicular to the pool base, and in a case that the inflatable pool is inflated, a corner is formed on the inner wall at a position of each of the inner wall joints; and the outer wall is provided with at least one outer wall joint extending along the direction perpendicular to the pool base; wherein a top of the inner wall and a top of the outer wall are connected by an edge sealing layer;

the edge sealing layer located at the top is provided with at least two edge sealing joints; and wherein the inflatable pool further comprises at least one second reinforcing layer configured to coat edges of the edge sealing joints and an edge of the edge sealing layer.

2. The inflatable pool according to claim 1, wherein at the position of each of the inner wall joints, the inner wall is broken along the direction perpendicular to the pool base, and the broken inner wall is connected through the inner wall joints.

3. The inflatable pool according to claim 2, wherein the drop stitch structure located between the inner wall and the outer wall is broken at a position corresponding to each of the inner wall joints.

4. The inflatable pool according to claim 1, wherein the inner wall is folded into the drop stitch structure at the position of each of the inner wall joints, and the folded inner wall is connected through the inner wall joints.

5. The inflatable pool according to claim 1, wherein at the position of the outer wall joint, the outer wall is broken along the direction perpendicular to the pool base, and the broken outer wall is connected through the outer wall joint.

6. The inflatable pool according to claim 5, wherein a position of the outer wall joint corresponds to the position of the inner wall joint located at the corner.

7. The inflatable pool according to claim 1, wherein the inner wall is connected by the inner wall joints adopting an edge sealing material, and the outer wall is connected by the outer wall joint adopting the edge sealing material, to form a sealing layer.

8. The inflatable pool according to claim 7, further comprising at least one first reinforcing layer configured to coat the sealing layer and edges of the sealing layer.

9. The inflatable pool according to claim 1, wherein a bottom of the inner wall and a bottom of the outer wall are connected by another edge sealing layer.

10. The inflatable pool according to claim 9, wherein two ends, located at two sides of each of the edge sealing joints, of the edge sealing layer are connected in an overlapping manner at a position of the corresponding edge sealing joint.

11. The inflatable pool according to claim 10, wherein positions of the edge sealing joints correspond to positions of the inner wall joints.

12. The inflatable pool according to claim 10, wherein the second reinforcing layer is provided on an outer side and/or an inner side of the inflatable chamber.

13. A method for manufacturing an inflatable pool, wherein the inflatable pool is the inflatable pool according to claim 1, and the method comprises following steps:

preparing a pool wall of a drop stitch material, and making the pool base be surrounded by the pool wall to form the water accommodation basin; wherein the pool wall comprises the inner wall, the outer wall, and the drop stitch structure between the inner wall and the outer wall;

providing the at least two inner wall joints, each extending along the direction perpendicular to the pool base, on the inner wall;

providing the at least one outer wall joint, extending along the direction perpendicular to the pool base on the outer wall; and forming, by the inner wall the corner at each of the inner wall joints after the inflatable pool is inflated.

14. The method for manufacturing the inflatable pool according to claim 13, wherein before being provided with the inner wall joints, the inner wall is first broken along the direction perpendicular to the pool base, or folded into the drop stitch structure, and then the inner wall which is broken or folded, is connected through the inner wall joints; and before being provided with the outer wall joint, the outer wall is first broken along the direction perpendicular to the pool base, and then the outer wall which is broken, is connected through the outer wall joint.

15. The method for manufacturing the inflatable pool according to claim 14, wherein in a case that the inner wall is broken, the drop stitch structure located between the inner wall and the outer wall is required to be broken at a position corresponding to each of the inner wall joints before the inner wall joints are provided.

* * * * *